US006749529B1

(12) United States Patent
Sobolewski

(10) Patent No.: US 6,749,529 B1
(45) Date of Patent: Jun. 15, 2004

(54) BACK FOOT PIVOT

(76) Inventor: Michael Sobolewski, 205 Stourbridge, Versailles, KY (US) 40383

( * ) Notice: Subject to any disclaimer, the term of this patent is extended or adjusted under 35 U.S.C. 154(b) by 0 days.

(21) Appl. No.: 10/192,160

(22) Filed: Jul. 11, 2002

(51) Int. Cl.[7] ..... A63B 69/00
(52) U.S. Cl. ..... 473/451
(58) Field of Search ..... 473/451–452, 473/217, 269–270; 482/71; D6/455

(56) References Cited

U.S. PATENT DOCUMENTS 3,372,930 A 3/1968 Sertich
4,560,165 A 12/1985 Witteman et al.
5,318,290 A 6/1994 Sawyer
5,810,673 A 9/1998 Castleberry
6,425,490 B1 * 7/2002 Ta ..... 211/116

* cited by examiner

*Primary Examiner*—Stephen P. Garbe
*Assistant Examiner*—M. Chambers
(74) *Attorney, Agent, or Firm*—Patent & Trademark Services, Inc; Joseph H. McGlynn

(57) ABSTRACT

A swing trailer having a first plate rotatably attached to a second plate and a foot placement device on top of the first plate, and a first stop on the first plate and a second and a third stop on the second plate. The engagement of the first stop with the second and third stops limit rotation of the first and second plates to approximately 90°.

2 Claims, 2 Drawing Sheets

BACK FOOT PIVOT

BACKGROUND OF THE INVENTION

This invention relates, in general, to a swing trainer, and, in particular, to a swing trainer that has a predetermined rotation.

DESCRIPTION OF THE PRIOR ART

In the prior art various types of swing trainers have been proposed. For example, U.S. Pat. No. 5,810,673 to Castleberry discloses a swing training device having an upper and lower plate that rotate with respect to each other. However, this device is huge, long, not light weight abd has no stop.

U.S. Pat. No. 5,318,290 to Sawyer discloses a swing training device having an upper and lower plate that rotate with respect to each other. However, this device is not portable, cannot be used on any surface, and you need tools, i.e. a hammer to pound spikes into the ground to set it up. In addition, there is no stopper and no ball bearings.

U.S. Pat. No. 4,560,165 to Witten et al. discloses a swing training device having an upper and lower plate that rotate with respect to each other and a spring torsion device. However, this device is huge, not light weight, has no stopper and is too tall.

U.S. Pat. No. 3,372,930 to Sertich discloses a swing training device having an upper and lower plate that rotate with respect to each other and a strop to hold the user's foot. However, this device has no stopper, does not have an easy glide bearing system, will not work on any surface, and need tools, i.e. a hammer to place on the insulation.

In contrast to these prior art references and the known prior art, the present invention provides a swing trainer having an upper and lower plate that rotate with respect to each other wherein the plates have a system limiting the rotation to a predetermined angle.

SUMMARY OF THE INVENTION

The present invention provides a swing trainer having an upper and lower plate wherein the upper and lower plates are pivotally attached to each other. Attached to the upper and lower plate is a system that limits the rotation of the upper plate to a predetermined angle.

It is an object of the present invention to provide a new and improved swing trainer system that is easy to use and needs no tools or special equipment to set up.

It is an object of the present invention to provide a new and improved swing trainer system that is light weight.

It is an object of the present invention to provide a new and improved swing trainer system that is small and portable and can be used on any type of surface.

It is an object of the present invention to provide a new and improved swing trainer system that can be used indoors or out doors.

These and other objects and advantages of the present invention will be fully apparent from the following description, when taken in connection with the annexed drawings.

DESCRIPTION OF THE PREFERRED EMBODIMENT

Back foot lockout is one of the most common problems facing many baseball players and golfers, which is not addressed by hitting instructors and coaches. Back foot lockout occurs when the athlete fails to properly rotate their back foot during the course of their swing. This improper rotation of the back foot creates an improper or, in some circumstances, no rotation of the athlete's hip.

On the other hand, the present invention is designed to create muscle memory so that the muscle will react in a particular way to create a smooth, effective rotation of the back foot. The present invention trains the athlete through repetition and without conscious thought so that the athlete will have the proper hip movement creating a proper swing.

Figure 1:
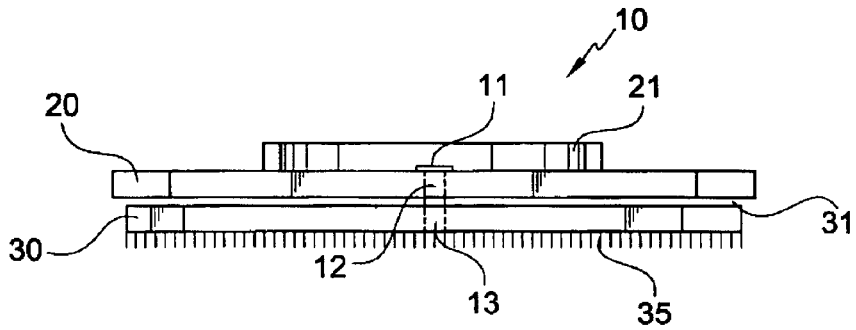
FIG. 1 is a side view of the present invention.

Referring to the drawings in greater detail, FIG. 1 shows the present invention 10 having fastening device 11, holes 12 and 13, first plate 20, foot placement device 21, second plate 30, and attachment device 35. While FIG. 1 shows that first plate 20 and second plate 30 are about the same length, one of ordinary skill would readily realize that the lengths of first plate 20 and second plate 30 may be different. For example, second plate 30 may be larger than first plate 20 allowing a user to place the present invention on an object to ensure that the present invention 10 will not shift when a user's foot is placed on the present invention 10.

First plate 20 is manufactured from materials well known within the art to be lightweight and rigid such as, but not limited to, steel or plastics. First plate 20 has a top and bottom wherein the top and both form a predetermined thickness. A hole 12 is placed approximately in the center of plate 20 and hole 12 is, preferably, not threaded. During manufacture, the thickness of plate 20 is relatively uniform, however, plate 20 may be manufactured using different thickness. As the thickness of plate 20 increases, plate 20 will flex less when pressure is exerted upon it.

Figure 2A:
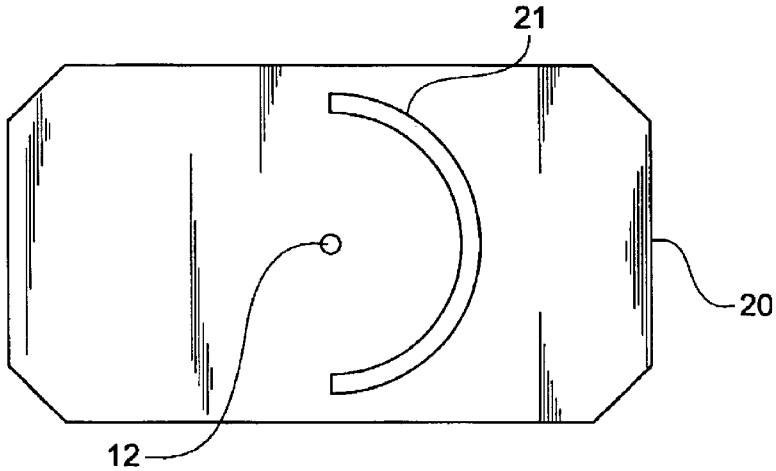
FIG. 2*a* is a top view of the first plate of the present invention.

Attached to plate 20 is foot placement device 21, which is shown in greater detail in FIG. 2*a*. Foot placement device 21 is substantially rounded (as shown in FIG. 2*a*). The foot placement device 21 is elevated from plate 20 by a predetermined height of, preferably, 1½ inches. The foot placement device 21 enables the user to center the ball of their foot when using the present invention 10. The top of plate 20 may also feature artificial turf.

Similar to plate 20, plate 30 has a top and bottom and is of a predetermined thickness. Preferably, since plate 30 rests upon a driving range mat or the ground, plate 30 need not be as thick as plate 30, which allows the present invention 10 to be lightweight. Second plate 30 is manufactured from materials well known within the art to be lightweight and rigid such as, but not limited to, steel, plastics, or the like. In an alternative embodiment, plate 20 may be manufactured from a first material and plate 30 may be manufactured from a second material, whereby the first and second plate materials are different. Hole 13 is approximately in the center of second plate 30. While holes 12, 13 are described as being approximately in the center of both first plate 20 and second plate 30, other placements of hole 12, 13 would not depart from the scope of the present invention 10.

Both plate 20 and plate 30 are attached to each other by attachment device 11 passing through respective holes 12, 13 in plate 20 and plate 30. Attachment device 11 may be any device known within the art that is used to attach objects together as long as first plate 20 may rotate with respect to second plate 30. For example, first plate 20 may have a non-threaded hole 12 and second plate 30 may have a threaded hole 13. A screw 11 will be threaded to plate 30, but not to plate 20 to allow plate 20 to rotate with respect to plate 30. If a screw is used as the attachment device 11, the user may assemble and disassemble the present invention 10 to transport the present invention 10 and deploy it in various areas. In other embodiments, the attachment device may be a rivet whereby both plate 20 and plate 30 are permanently attached to each other and first plate 20 is allowed to rotate with respect to second plate 30. In yet another embodiment, a snap connection is the attachment device 11 whereby both first plate 20 and second plate 30 are attached to each other.

FIG. 2*a* is a top view of plate 20. While plate 20 is shown as being substantially rectangular in shape with rounded-off corners, one of ordinary skill would realize that plate 20 may be any shape well known within the art.

As described above, the foot placement device 21 is a substantially circular device. Preferably, during the construction of the present invention 10, foot placement device 21 is attached to plate 20 by means well known within the art. In alternative embodiments, both first plate 20 and foot placement device 21 may be of unitary construction. Foot placement device 21 also prevents a force on plate 20 from interfering with the operation of the present invention 10.

Figure 2B:
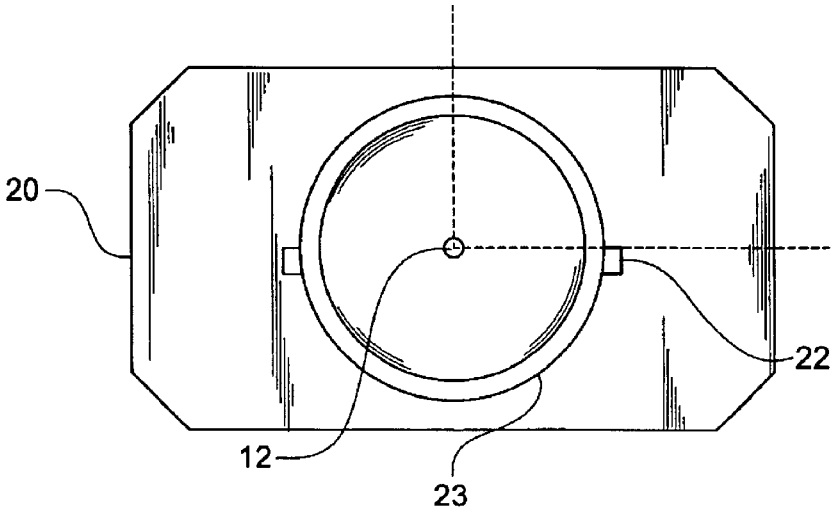
FIG. 2*b* is a bottom view of the first plate of the present invention.

FIG. 2*b* is a bottom view of plate 20 having hole 12, first projection or stop 22 and indent canal 23. Stop 22 is part of the system that is used to limit the rotation of plate 20 to a predetermined arc. Plate 20 and stop 22 are attached to plate 20 by any conventional means or could be of unitary, one-piece construction. Stop 22 projects outward by a predetermined length and a predetermined width.

The bottom of plate 20 also features indented canal or groove 23 which allows plate 20 to rotate about a vertical axis through hole 12. Additionally, canal 23 allows a friction reducing system to be used, which will be described below. Foot placement device 21 is placed over canal 23, therefore, as a force is exerted on the foot placement device 21, the force is directly applied to a friction reduction system located beneath plate 20. This placement of the foot placement device 21 over the indented canal 23 also prevents other portions of plate 20 from touching plate 30 thereby providing a near friction-free environment.

Figure 3A:
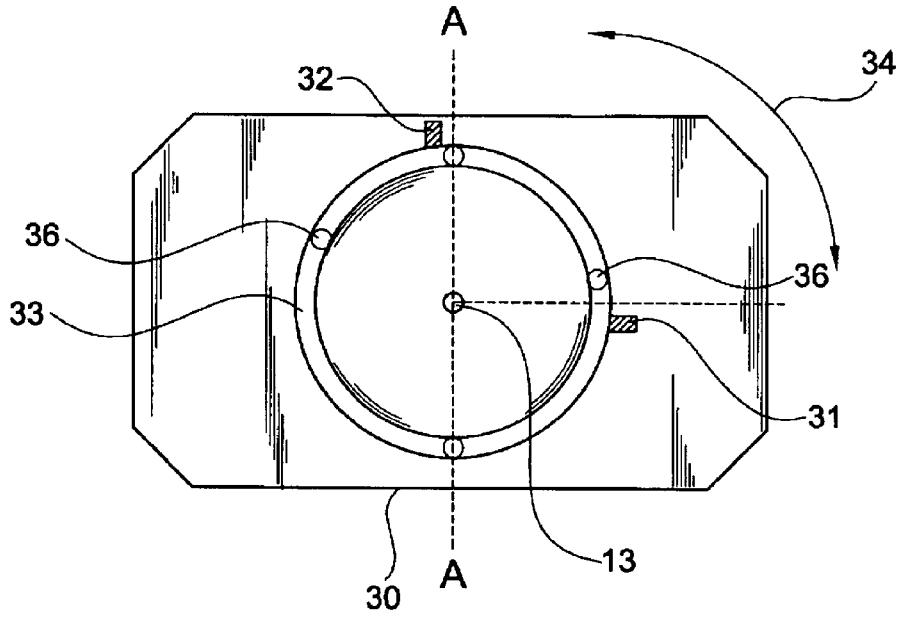
FIG. 3*a* is a top view of the second plate of the present invention.

FIG. 3*a* is a top view of plate 30 of the present invention 10 having hole 13, second stop 31, third stop 32, and friction reducing system 33. While plate 30 is shown as being substantially rectangular in shape with rounded-off corners, plate 30 may be any shape well known within the art. Additionally, while plate 20 and plate 30 are described as being substantially identical in shape and size, plate 20 and plate 30 may differ in both size and shape.

Friction reducing system 33 is attached to the top of plate 30 by any conventional means. The friction reducing system 33 may be any means known within the art for the purpose of reducing friction between two objects such as, but not limited to, ball bearings 36, or the like. The size and shape of friction reducing system 33 is nearly identical to the size and shape of indented canal 23 found on first plate 20. This allows the friction reducing system 33 to occupy the space of the indented canal 23 thereby providing a frictionless rotational movement while substantially preventing movement in the horizontal or vertical direction. As stated above, since the foot placement device 21, that is part of plate 20, substantially overlies the indented canal 23, which is on the bottom of plate 20, a force exerted upon the foot placement device 21 is exerted through plate 20 and to the friction reducing system 33 attached to the top of plate 30.

Attached to the top of plate 30 is second stop 31 and third stop 32. As shown in FIG. 3*a*, third stop 32 is slightly left of an imaginary line AA through the center of plate 30, and stop 31 is positioned approximately 90° clockwise from stop 32. Stop 31 and stop 32 form an imaginary arc 34 of a predetermined angle, preferably about 90°.

Figure 3B:
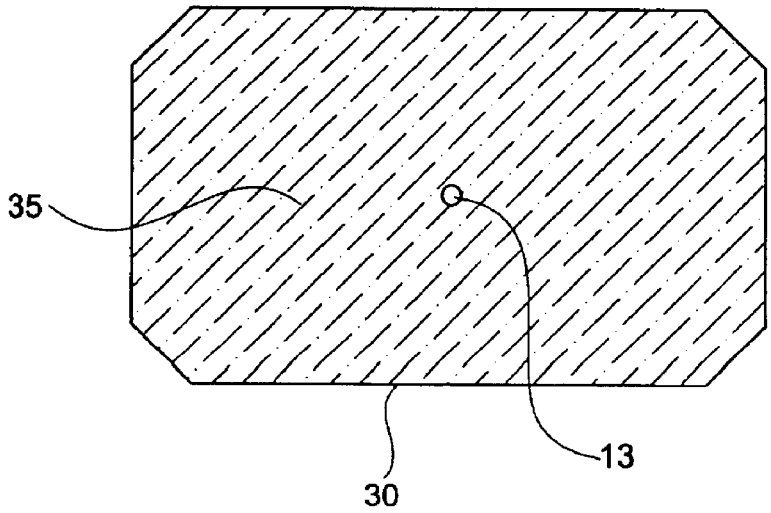
FIG. 3*b* is a bottom view of the second plate of the present invention.

FIG. 3*b* is a bottom view of plate 30 having hole 13 and a attachment device 35. The attachment device 35 is affixed to the bottom of plate 30 by any conventional means and is any conventional gripping surface which prevents the present invention 10 from moving or shifting when in use.

Second stop 31 and third stop 32 limit the arc that plate 20 may traverse. This limitation is because the first stop 22 will hit either the second stop 31 or the third stop 32 when plate 20 rotates either clockwise or counterclockwise. As stated above, it is preferable that plate 20 rotates 90°, but one of ordinary skill would realize that other arcs may be beneficial. While the present invention 10, is described as using first stop 22, second stop 31, and third stop 32, it should be understood that any rotational limiting system may be used to limit the rotation of plate 20 with respect to plate 30 to a predetermined arc.

In order to use the present invention 10, the user will set the present invention on a object such as, but not limited to, the ground, baseball diamond, grass, driving range, or the like. The attachment device 35 is a gripping surface of any conventional design and will prevent the present invention 10 from moving in a horizontal or vertical direction. Next, the user will place one foot on the object and the second foot, preferably their back foot, on the present invention 10. The ball of the second foot should be placed on the foot placement device 21. Preferably, the first foot and second foot of the user should be placed about shoulder width apart. Once the first foot is placed on the object and the second foot is placed upon the present invention 10, the user will rotate the second foot until stop 21 of plate 20 impacts with stop 31 of plate 30. As described above, the arc of this rotation is about 90°, but is dependent upon the imaginary arc 34 of the second stop 31 and third stop 32. When the stop 21 engages stop 31, both feet of the user are substantially parallel with respect to each other. In order to practice this movement, the user then must rotate their second foot by a predetermined angle, preferably 90°, so that the heel of the second foot is thrust backward, away from the body. This rotation of the back foot will cause the user's hip to rotate properly.

Although the back foot pivot and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

I claim:

1. A swing training apparatus comprising:

a first plate having a top and a bottom, a second plate having a top and a bottom, said first plate is positioned over said second plate, said first plate is rotatably attached to said second plate, and means for limiting the rotation of said first and second plate to a predetermined angle of approximately 90 degrees, and wherein said means for limiting said rotation of said first and second plate comprises:

only a single first stop attached to the bottom of the first plate, and a second stop and a third stop attached to the top of said second plate, and wherein said single first stop lies between the second stop and the third stop when said first and second plates are assembled, and said single first stop moves from a first position to a second position as said first plate rotates with respect to said second plate, and when said single first stop is in said first position it engages said second stop, and when said single first stop is in said second position it engages said third stop, and wherein a groove is positioned on said bottom of said first plate, and a groove is positioned on said top of said second plate, and ball bearings are placed in said groove on said bottom of said first plate, and in said groove on said top of said second plate, and wherein said single first stop is positioned directly adjacent said groove in said bottom of said first plate.

2. A swing training apparatus comprising:

a first plate having a top and a bottom, a second plate having a top and a bottom, said first plate is positioned over said second plate, said first plate is rotatably attached to said second plate, and means for limiting the rotation of said first and second plate to a predetermined angle of approximately 90 degrees, and wherein said means for limiting said rotation of said first and second plate comprises:

only a single first stop attached to the bottom of the first plate, and a second stop and a third stop attached to the top of said second plate, and wherein said single first stop lies between the second stop and the third stop when said first and second plates are assembled, and said single first stop moves from a first position to a second position as said first plate rotates with respect to said second plate, and when said single first stop is in said first position it engages said second stop, and when said first stop is in said second position it engages said third stop, and wherein a groove is positioned on said bottom of said first plate, and a groove is positioned on said top of said second plate, and ball bearings are placed in said groove on said bottom of said first plate, and in said groove on said top of said second plate, and wherein said second and third stops are positioned directly adjacent said groove in said top of said second plate.

* * * * *